US006386749B1

(12) United States Patent
Watts et al.

(10) Patent No.: US 6,386,749 B1
(45) Date of Patent: May 14, 2002

(54) SYSTEMS AND METHODS FOR HEATING AND MIXING FLUIDS

(75) Inventors: Richard P. Watts, San Mateo, CA (US); Stephen D. Mitchell, Sr., Woodbine, MD (US)

(73) Assignee: Affymetrix, Inc., Santa Clara, CA (US)

( * ) Notice: Subject to any disclaimer, the term of this patent is extended or adjusted under 35 U.S.C. 154(b) by 0 days.

(21) Appl. No.: 09/603,862

(22) Filed: Jun. 26, 2000

Related U.S. Application Data

(60) Provisional application No. 60/222,675, filed on Aug. 2, 2000.

(51) Int. Cl.[7] ..... B01F 15/06; B01F 9/00; B01L 3/00

(52) U.S. Cl. ..... 366/144; 366/214; 211/41.1; 211/1.53; 211/1.55; 422/102; 435/809

(58) Field of Search ..... 366/209, 214, 366/144, 218, 220, 235; 211/1.52, 1.53, 1.55, 85.13, 41.1; 422/99, 913, 104, 103, 102; 435/303.1, 303.3, 809

(56) References Cited

U.S. PATENT DOCUMENTS 1,185,865 A * 6/1916 Bates ..... 366/214
3,231,244 A * 1/1966 Moody et al. ..... 366/214
4,118,280 A * 10/1978 Charles et al.
4,301,718 A * 11/1981 Lewinger et al. ..... 366/214
4,329,068 A * 5/1982 Neuner et al. ..... 366/214
4,643,879 A * 2/1987 Hanaway
4,801,431 A * 1/1989 Cumo et al. ..... 422/104
4,892,412 A * 1/1990 Thomas et al. ..... 366/214
4,907,893 A * 3/1990 Niemeck et al.
5,266,272 A * 11/1993 Griner et al. ..... 422/104
5,650,125 A * 7/1997 Bosanquet ..... 422/102
5,753,187 A * 5/1998 Reynols et al. ..... 422/102
6,050,719 A * 4/2000 Winkler et al. ..... 366/214

* cited by examiner

*Primary Examiner*—Tony G. Soohoo
(74) *Attorney, Agent, or Firm*—Townsend and Townsend and Crew LLP

(57) ABSTRACT

A mixing system comprises an elongate rotatable shaft having a rotational axis. A plurality of holding members extend radially outward from the shaft and are configured to rotate with the shaft. The system further includes a plurality of carriers that are insertable between two of the holding members. Each of the carriers includes a plurality of grooves, pairs of which are adapted to receive a cartridge having a chamber for holding a liquid.

38 Claims, 9 Drawing Sheets

SYSTEMS AND METHODS FOR HEATING AND MIXING FLUIDS

This application claims benefit to U.S. provisional application Ser. No. 60/222,675, filed Aug. 2, 2000.

BACKGROUND OF THE INVENTION

This invention relates generally to the field of mixing, and in particular to the mixing of fluids. In one particular aspect, the invention relates to the mixing of biological fluids within a chamber that is disposed within a heated environment.

Methods for using arrays of polymers to identify receptors with specific affinities for one of the polymers in the array are known. For example, one method uses immobilized antibodies to analyze binding to peptide ligands or vice-versa. Another type of method uses immobilized oligonucleotides to analyze hybridization to a target nucleic acid. For instance, U.S. patent application Ser. No. 08/624,312, filed Mar. 26, 1996, the complete disclosure of which is herein incorporated by reference, describes apparatus and methods for carrying out repeated hybridizations of a target nucleic acid to an array of nucleic acid probes. Such polymer arrays are described in, e.g., U.S. Pat. No. 5,143,854 and published PCT Application Nos. WO90/15070 and WO92/10092, the complete disclosures of which are herein incorporated by reference. These polymer arrays are nucleic acid arrays which include a plurality of different polynucleotides coupled to a substrate in different known locations.

In one exemplary arrangement, such arrays are packaged within a housing, like those described in, e.g., U.S. Pat. No. 5,945,334, and in copending U.S. patent application Ser. No. 08/624,312, previously incorporated by reference, Ser. No. 08/528,173, filed Sep. 19, 1995, now U.S. Pat. No. 6,140,044, and published PCT Application No. WO95/33846. The disclosures of all of these references are herein incorporated by reference. In brief, such a housing typically includes a body having a reaction cavity or hybridization chamber. The array or substrate is mounted over the cavity on the body such that the front side of the array substrate, e.g., the side upon which the polynucleotides are situated, is in fluid communication with the cavity. The cartridge includes inlet and outlet ports to allow various fluids to be introduced into and removed from the hybridization chamber.

During hybridization, it is often desirable to provide an efficient and effective way to mix the fluids within the chamber. This can be challenging since the chamber is typically in a temperature controlled environment, such as in an oven. Additionally, in at least one embodiment, the interior of the chamber is narrow, and it can be difficult to mix or agitate the fluid when within the chamber.

One exemplary technique for mixing fluids in a heated environment is described in copending U.S. application Ser. No. 09/032,724, filed Feb. 27, 1998, now U.S. Pat. No. 6,050,719 the complete disclosure of which is herein incorporated by reference. According to this technique, a set of cartridges may be positioned within an oven and then rotated to facilitate mixing of a fluid.

This invention is related to other techniques to facilitate the mixing of fluids which are held within a hybridization chamber to improve the hybridization process. The techniques of the invention are particularly well suited for mixing fluids within a temperature controlled environment, such as an oven.

SUMMARY OF THE INVENTION

In one embodiment, a mixing system comprises an elongate rotatable shaft having a rotational axis. A plurality of holding members extend radially outward from the shaft and are configured to rotate with the shaft. The system further includes a plurality of carriers that are insertable between two of the holding members. Each of the carriers includes a plurality of grooves, pairs of which are adapted to receive a cartridge having a chamber for holding a liquid. In this way, rotation of the shaft rotates the carriers about the rotational axis to mix the liquid within the cartridges.

In one particular aspect, a heating system may also be provided and comprises an oven having an interior and a motor. With such a configuration, the shaft may be horizontally disposed across the interior and coupled to the motor so that the motor may be employed to rotate the shaft. Further, a controller may be provided to control operation of the motor and the temperature within the interior.

In another aspect, the carriers may each comprise a carrier body having a bottom, a plurality of sides, an open top, and a projection extending from the sides. With such a configuration, the holding members may include slots for receiving the projections of the carriers. In this way, the carriers may simply be inserted into the slots.

In still another aspect, the grooves of the carrier are arranged such that the cartridges are parallel to each other when inserted into the grooves. In this way, multiple cartridges may be held within a single carrier. Conveniently, the grooves may be keyed such that the cartridges are insertable in only one orientation. In this manner, each of the cartridges will be similarly oriented to permit each cartridge to be rotated in the same manner.

Conveniently, a locking mechanism may be provided to lock the carrier to the holding members. As one example, at least one of the projections may include a knob, and the locking mechanism may comprise a biasing member that is received over the knob to lock the carrier to the holding member. Optionally, a plurality of holding bars may be positioned between the holding members. The holding bars may be configured to be placed adjacent a top end of the cartridges that extend above the top end of the carriers to hold the cartridges within the carriers when the shaft is rotated.

In another aspect, the slots in the holding members may be placed 90 degrees apart to permit four carriers to be held between two of the holding members. In one specific aspect, three holding members may be provided, with the middle holding member having slots for carriers positioned on opposite sides of the middle holding member.

Advantageously, the cartridges may include a pair of closely spaced apart walls that define the chamber, with the distance between the walls being less that the distance across either of the walls. With this arrangement, the carriers may be attached to the holding members such that the walls of the chambers are perpendicular to the rotational axis.

In another embodiment, a method is provided for heating and mixing a liquid. According to the method, a plurality of cartridges are provided that each have a chamber at least partially filled with a liquid. The cartridges are placed into grooves of a plurality of carriers, and the carriers are inserted between a pair of holding members that extend radially outward from a shaft having a rotational axis. The shaft is rotated to rotate the cartridges around the rotational axis. In so doing, the liquid within the chambers is mixed.

Preferably, the cartridges are also heated while rotating the shaft. For example, the cartridges may be rotated within a heated oven. In one aspect, the rotational axis of the shaft is horizontal during rotation. Such a configuration is particularly useful when the cartridges include a pair of closely spaced apart walls that define the chamber, with the distance between the walls being less that the distance across either of the walls. In this way, the carriers may be inserted between the holding members such that the walls of the chambers are perpendicular to the rotational axis. Further, the cartridges may include sides extending between the faces to further define the chamber, with the sides forming corners. As the carriers are inserted between the holding members, the corners are parallel to the rotational axis. In this manner, rotation of the cartridges agitates the liquid within the chambers as the flow of the liquid changes direction due to the change in direction of the sides.

In another aspect, the carriers each comprise a carrier body having a bottom, a plurality of sides, an open top, and a projection extending from opposite sides. In this way, the projections may be inserted into slots in the holding members. In still another aspect, the cartridges may be placed into the grooves of the carrier such that the cartridges are parallel to each other. Conveniently, insertion of the cartridges into the grooves may be prevented unless the cartridges are in a certain orientation. In this way, each of the cartridges will be inserted with the same orientation so that each cartridge will be rotated in the same manner.

In one particular aspect, the carriers are locked to the holding members to prevent their removal during rotation. Also, the cartridges may be prevented from sliding out of the carriers when the shaft is rotated.

DESCRIPTION OF THE SPECIFIC EMBODIMENTS

Figure 1:
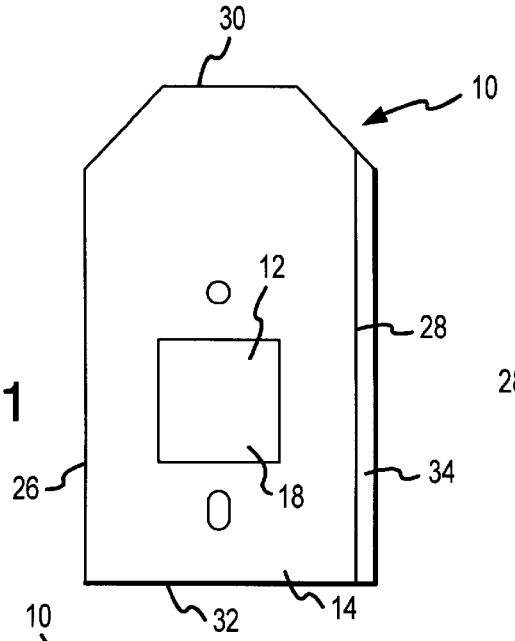
FIG. 1 is a front view of one embodiment of a cartridge according to the invention.
Figure 2:
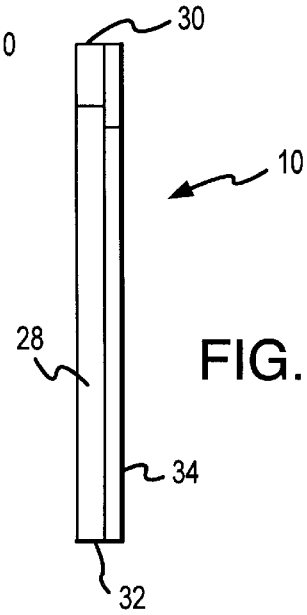
FIG. 2 is a side view of the cartridge of FIG. 1.
Figure 3:
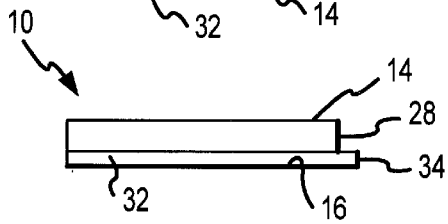
FIG. 3 is an end view of the cartridge of FIG. 1.
Figure 4:
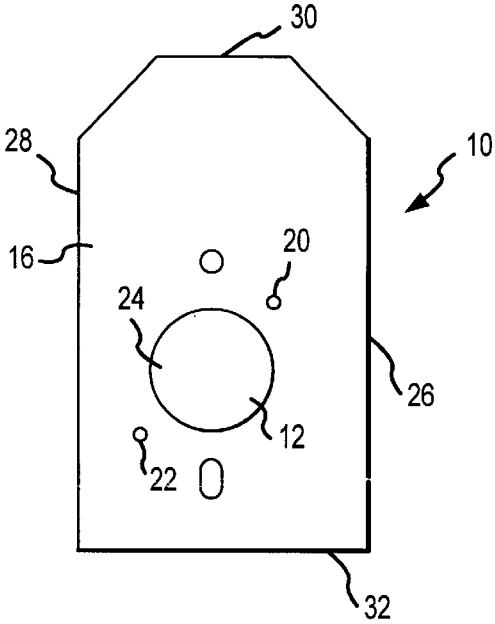
FIG. 4 is a rear view of the cartridge of FIG. 1.

The invention provides exemplary devices, systems and methods to facilitate the mixing of fluids that are held within a chamber, and will preferably be used in connection with biological fluids. Although useful in mixing a wide variety of biological fluids, the invention will find its greatest use when mixing a sample within a hybridization chamber having a polymer array. Although the invention will find particular use in connection with hybridization reactions and, more specifically, nucleic acid hybridizations, it should be appreciated that the invention will be useful in facilitating a variety of reactions where mixing is required, including, e.g., extension or amplification reactions using tethered probes as template or primer sequences, screening of receptors against arrays of small molecules, peptides or peptideomimetics, carbohydrates, and the like.

The invention will find use in facilitating the mixing of fluids within chambers having a wide variety of configurations and geometries. However, the invention will be particularly useful with chambers which are relatively narrow in geometry, e.g., defined by two closely spaced apart planar walls. Cartridges that include such chambers are described in U.S. Pat. No. 5,945,334 and in co-pending U.S. application Ser. Nos. 08/624,312 and 08/528,173 and PCT Application No. WO95/33846, previously incorporated herein by reference. For example, when used as a hybridization chamber, the walls may be separated by a distance in the range from about 0.5 mm to about 2.0 mm.

The invention provides for the mixing of the various fluids by rotating the chambers about a rotational axis that is generally perpendicular to the narrow chamber in a manner similar to that described in copending U.S. application Ser. No. 09/032,724, previously incorporated by reference. Rotation in this manner is particularly advantageous when the chamber includes corners, such as in a rectangular or square chamber. When rotating the chamber about the rotational axis, the fluid within the chamber will become agitated as the direction of flow is hindered due to the change in direction of the walls. In this way, mixing of the fluid is facilitated.

According to the invention, mixing will preferably occur while the chamber is within a temperature controlled environment. Typically, the chamber will be included within an oven or incubator so that the chamber may be heated while the chamber is being rotated. As described hereinafter, the invention provides equipment and techniques to facilitate the rotation of such chambers when held within an oven. Referring now to FIGS. 1–4, one embodiment of a cartridge 10 having a chamber 12 containing a fluid will be described. The fluid held within the chamber will preferably comprise a biological fluid. The cartridges may be of the type described generally in U.S. Pat. No. 5,945,334 and in co-pending U.S. application Ser. Nos. 08/624,312 and 08/528,173 and PCT Application No. WO95/33846, previously incorporated by reference. However, it will be appreciated that the invention is not intended to be limited for use only with such cartridges.

Cartridge 10 includes a front 14, a rear 16, and a cavity 12 which is defined in part by a generally planar face 18. Positioned across cavity 12 is an array chip (not shown). When the array chip is positioned over cavity 12, a hybridization chamber is formed. The hybridization chamber is generally rectangular or square in geometry and has a narrow width as defined by the distance between planar face 18 and the array chip. Extending between face 18 and the array chip are sides that intersect with each other to form corners and which further define the chamber. In one specific embodiment, the distance between face 18 and the array chip may be in the range from about 0.5 mm to about 2.0 mm. Further, face 18 may have a length of about 5 mm to about 15 mm and a width of about 5 mm to about 15 mm. An inlet port 20 and an outlet port 22 are included in rear 16 to allow various fluids to be introduced into and removed from the hybridization chamber. Rear 16 further includes a cavity 24, located adjacent the array, which is adapted for receiving a temperature monitoring and/or controlling device employed in other applications.

Cartridge 10 includes a pair of sides 26 and 28, a top 30 and a bottom 32. Extending from side 28 is an edge 34 that permits insertion of cartridge 10 into a carrier in only one orientation as described hereinafter.

Figure 5:
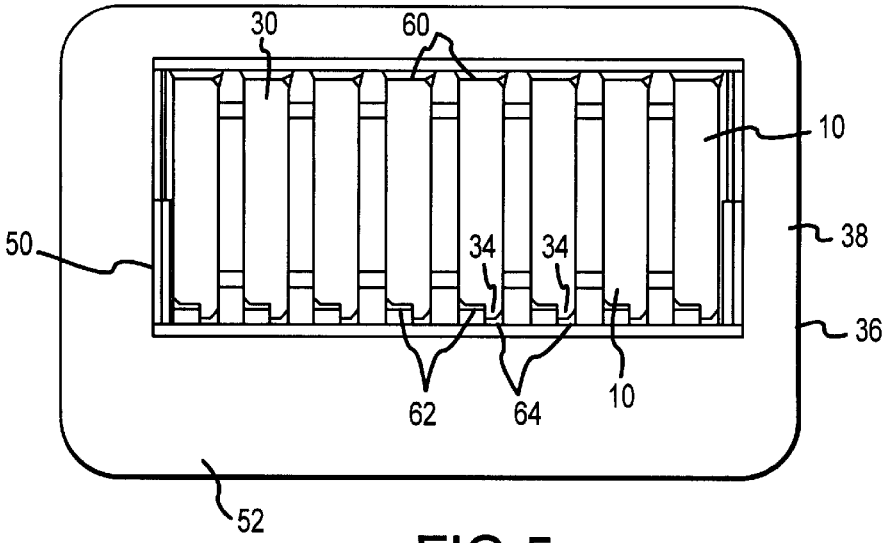
FIG. 5 is a top view of a carrier shown holding a plurality of cartridges according to the invention.
Figure 6:
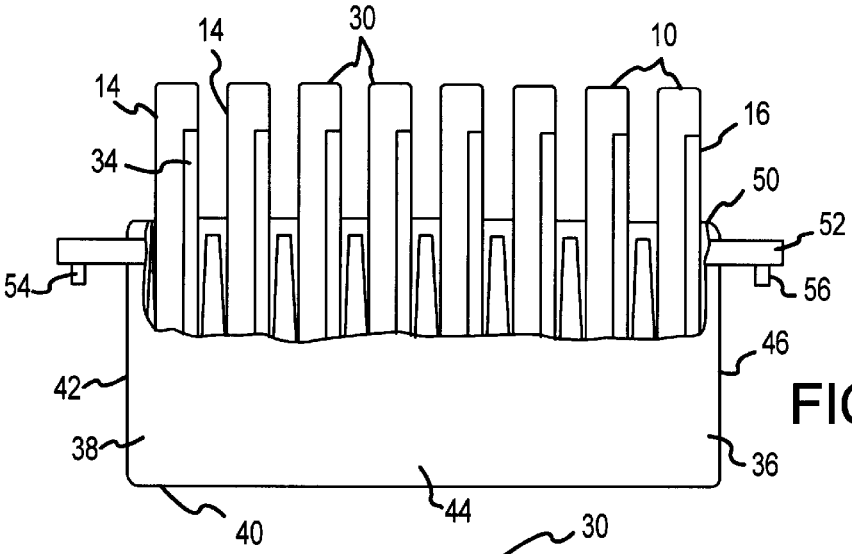
FIG. 6 is a partially cut away side view of the carrier and cartridges of FIG. 5.
Figure 7:
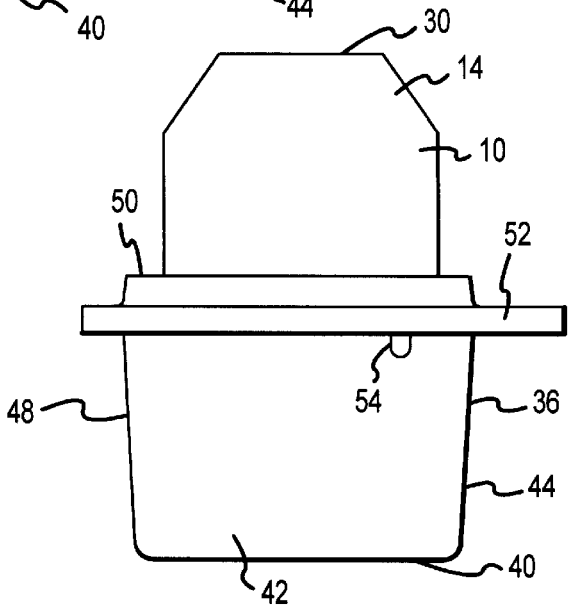
FIG. 7 is a side view of the carrier and cartridges of FIG. 5.

Referring now to FIGS. 5–9, an embodiment of a carrier 36 that may be used to hold a plurality of cartridges will be described. For convenience of illustration, FIGS. 5–7 illustrate carrier 36 holding a plurality of cartridges 10 that are identical to those just described. Carrier 36 comprises a carrier body 38 having a bottom 40, four sides 42, 44, 46 and 48, and a top 50. Extending from the sides is a projection 52 to facilitate coupling of carrier to a rotation device as described hereinafter. Conveniently, projection 52 may be oversized at side 44 to serve as a handle when inserting and removing carrier from a mixing device as described hereinafter. Further, carrier 36 may include a pair of knobs 54 and 56 to facilitate locking of carrier 36 within a mixing device.

Figure 8:
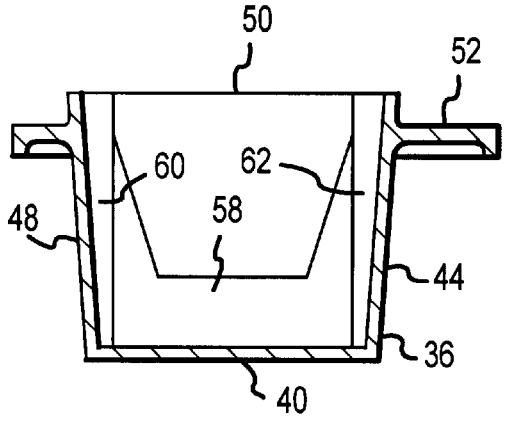
FIG. 8 is a cross sectional side view of the carrier of FIG. 7.
Figure 9:
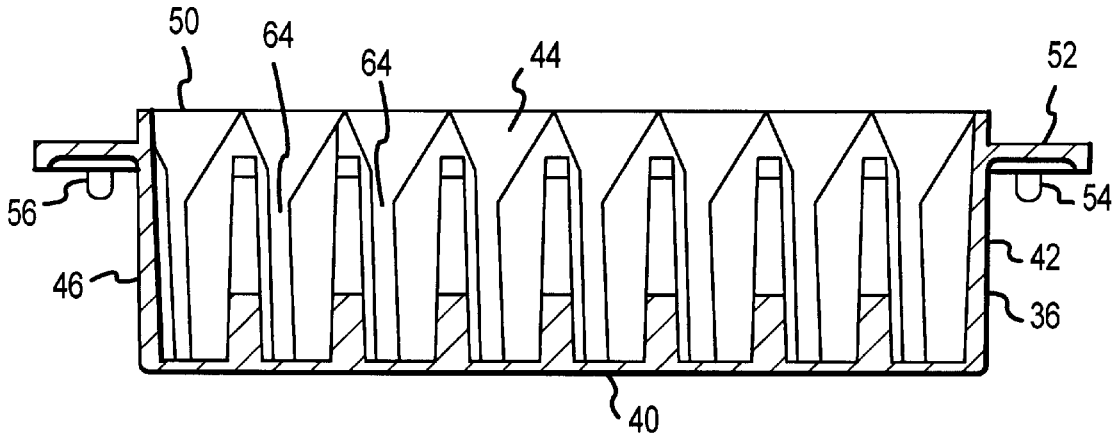
FIG. 9 is a cross sectional side view of the carrier of FIG. 6.

As best shown in FIG. 8, a plurality of walls 58 extend between sides 44 and 48. As shown in FIG. 5, walls 58 define pairs of grooves 60 and 62 into which cartridges 10 are inserted. Grooves 60 define a generally straight channel, while grooves 62 include a keyed notch 64 (see also FIG. 9). Carrier 10 is configured such that cartridges 10 may be received in only one specific orientation. More specifically, edge 34 may be received only within notch 64, and only when front 14 is parallel with side 42. In this way, sides 26 are received into grooves 60, sides 28 are received into grooves 62, and tops 30 of cartridges 10 extend above top 50 of carrier 36, with cartridges 10 each facing the same direction. In this way, the fluids within cartridges 10 will generally experience the same type of mixing when carrier 36 is rotated.

Figure 10:
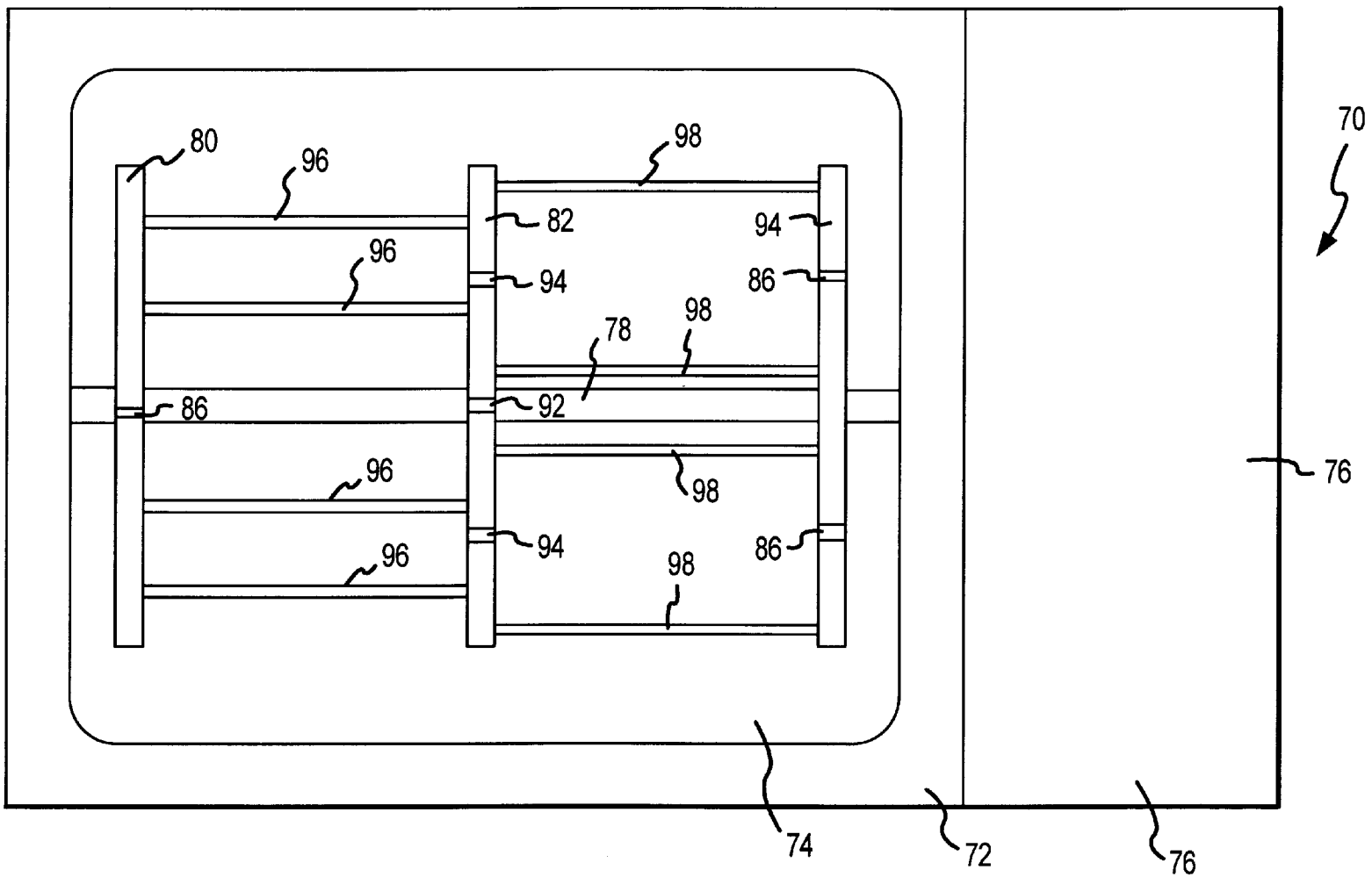
FIG. 10 is a front view of one embodiment of a heating and mixing system according to the invention.

Referring now to FIG. 10, one embodiment of a heating and mixing system 70 that may be used to heat and mix fluids held within cartridges 10 when they are held within carrier 36 will be described. System 70 comprises an oven 72 having an interior 74 that is enclosed by a door (not shown). Oven 72 further includes a control panel 76 that may include controls to operate the oven, including an on/off switch, a temperature controller, a temperature display, and the like. For example, the controls may be used to heat interior 74 to a temperature in the range from about 30 degrees C. to about 95 degrees C. during mixing. Conveniently, oven 72 may include many of the same components as a model H010 oven, commercially available from Stovall, Inc.

Extending horizontally across interior 74 is a shaft 78. Disposed behind control panel 76 is a motor that is coupled to shaft 78. Further, control panel 76 may optionally include a control to control starting and stopping of shaft rotation as well as the rate of rotation. Conveniently, oven 72 may be configured to begin rotation of shaft 78 when the door is closed. In one aspect, the motor may be configured to rotate shaft 78 at a rate in the range from about 30 rpm to about 90 rpm.

Figure 11:
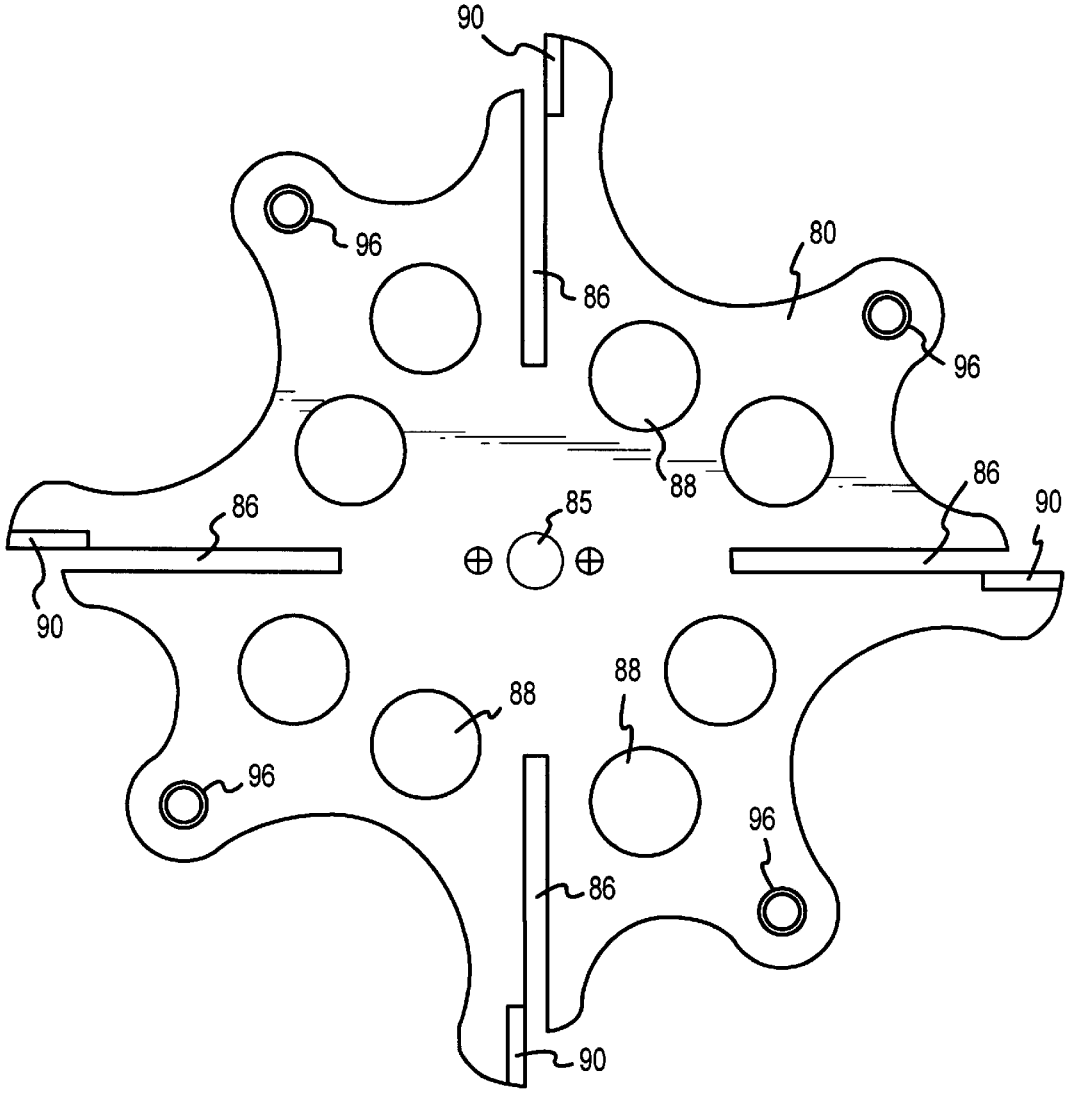
FIG. 11 is a side view of a holding member of the system of FIG. 10.

Coupled to shaft 78 are three holding members 80, 82 and 84 that are configured to hold carrier 36 within interior 74. The holding members are arranged such that multiple carriers may be held between holding members 80 and 82 and between holding members 82 and 84. As best shown in FIG. 11, holding member 80 includes a central hole 85 which permits holding member 80 to be coupled to shaft 78. Holding member 80 further includes four slots 86 that are each adapted to receive one of the projections 52 of carriers 36. In this way, holding member 80 may received up to four carriers 36 simply by inserting the carriers into slots 86. As the carriers are inserted, the overextended portion of projection 52 extends beyond holding member 80 to facilitate easy grasping of the carrier. Optionally, holding member 80 may include one or more openings 88 and/or cut outs to reduce the mass of holding member 80, thereby requiring less power to rotate the holding member. Further, each of slots 86 includes a recess 90 for receiving knob 54 of carrier 36 when inserted into slots 86.

Figure 12:
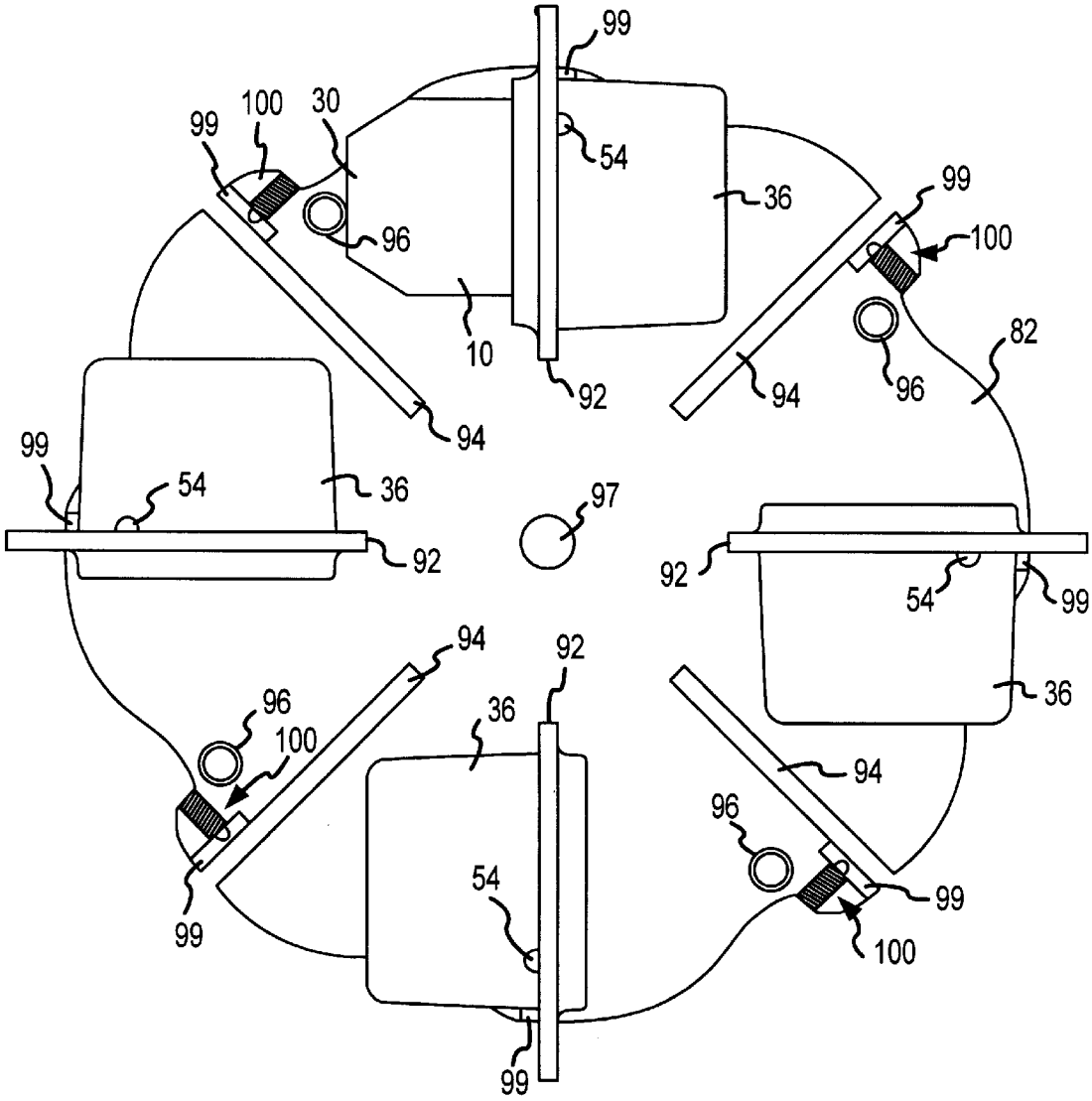
FIG. 12 is a side view of another holding member of the system of FIG. 10 shown holding a plurality of carriers.

As best shown in FIG. 12, holding member 82 includes four slots 92 and four slots 94. Slots 92 are separated from each other by 90 degrees, and slots 94 are separated from each other by 90 degrees. Further each slot 92 is separated by the adjacent slot 94 by 45 degrees. An opening 96 is provided to permit holding member 82 to be coupled to shaft 78. Further, as shown in FIG. 10, holding member 82 is coupled to shaft 78 such that slots 92 are aligned with slots 86 of holding member 80. In this way, four carriers may be held between holding members 80 and 82. Conveniently, holding member 84 may be configured to be identical to holding member 80. Holding member 84 is coupled to shaft 78 so that slots 86 are aligned with slots 94 of holding member 82. Such a configuration permits four additional carriers to be held between holding members 82 and 84. The use of holding member 82 to hold carriers that are also coupled to both holding members 80 and 84 is advantageous in that it minimizes the space required to hold the carriers. In this way, the size of interior 74 may be minimized while still permitting up to eight carriers to be rotated within oven 72.

Also shown in FIG. 12 are four carriers 36 that have been inserted into slots 92. Although not shown in FIG. 10, carriers 36 would also be inserted into slots 86 of holding member 80. As further shown in FIG. 10, extending between holding members 80 and 82 are a plurality of bars 96. As best shown in FIG. 12, when carrier 36 is inserted between holding members 80 and 82, top ends 30 of cartridges 10 are adjacent bars 96. In this way, as shaft 78 is rotated, cartridges are held within carriers 10. Similar bars 98 extend between holding members 82 and 84.

Figure 13:
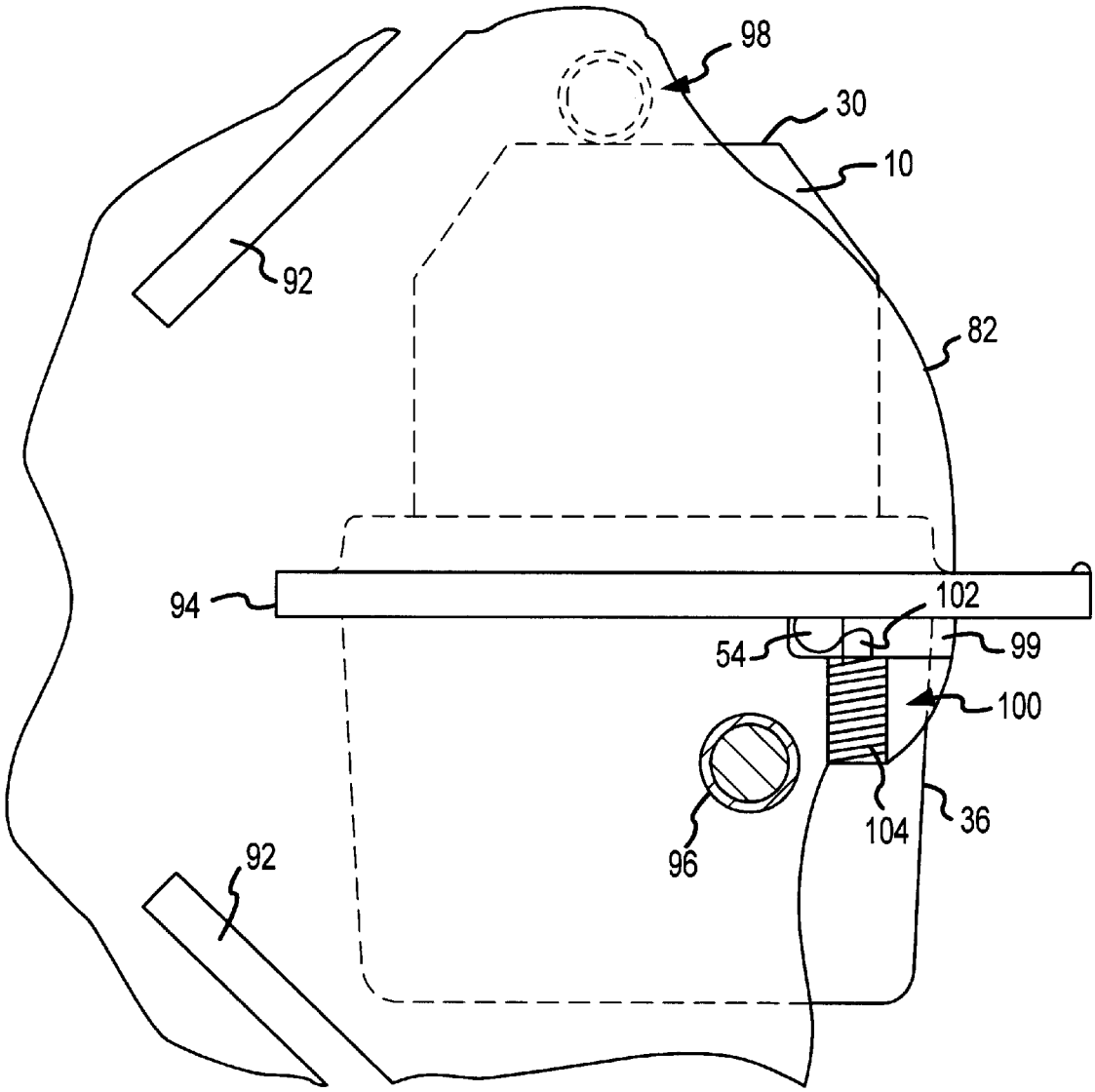
FIG. 13 is a more detailed view of a section of the holding member of FIG. 12 illustrating the coupling of a carrier from an opposite side of the holding member.

Slots 92 and 94 each include a recess 98 for receiving knob 54 or 56 of carrier 36 depending on which slot receives the carrier. Associated with slots 92 and 94 is a locking mechanism 100. Locking mechanism 100 engages knobs 56 of the carriers that are held between holding members 80 and 82, while locking mechanism 100 engages knobs 54 of the carriers held between holding members 82 and 84. As shown in FIG. 13, a carrier has been inserted between holding members 82 and 84. Locking mechanism 100 comprises a locking member 102 that is biased into recess 98 by a spring 104. As carrier 36 is inserted into slot 94, knob 54 enters into recess 98 until engaging member 102. Further insertion forces member 102 downward until knob 54 passes member 102. Spring 104 then forces member 102 upward to lock carrier 36 in place. Carrier 36 is removed by supplying sufficient force to move member 102 downward in a manner similar to that just described.

When carriers 36 are inserted into the holding members, cartridges 10 are positioned such that faces 12 are generally perpendicular to the axis of rotation of shaft 78. In this way, as cartridges 10 are rotated, the fluid within the hybridization chamber will flow against each side wall of the hybridization chamber to facilitate mixing of the fluid. More specifically, as the fluid within the chamber is flowed against each of the side walls in sequence, the fluid is agitated.

Hence, fluids within multiple cartridges 10 may be simultaneously mixed and heated in a uniform manner by inserted the cartridges into multiple carriers 36. The carriers are then inserted between two of the holding members until locked in place. The door over oven 72 is then closed and shaft 78 is rotated to rotate the cartridges about shaft 78 in a uniform manner. The temperature within interior 74 is also controlled so that each cartridge is uniformly heated. After an appropriate length of time, carriers 36 are removed from the oven. The cartridges may then be removed from the carriers for further processing and/or evaluation. Optionally, the cartridges may remain within the carriers which serve as a convenient transport device when moving the cartridges to another location.

Figure 14:
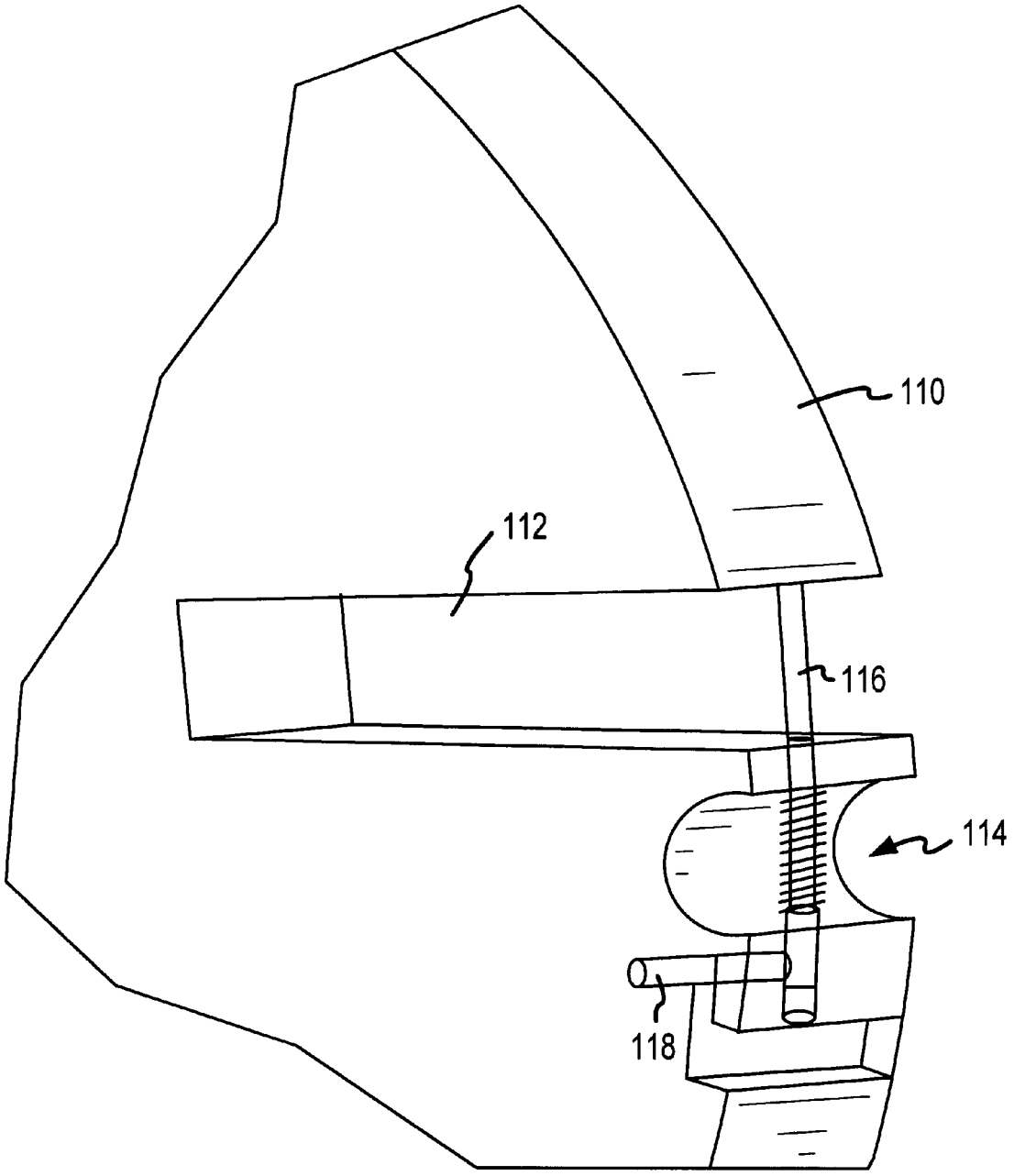
FIG. 14 illustrates an alternative holding member having an alternative locking scheme according to the invention.

Shown in FIG. 14 is an optional holding member 110 that may be used with system 70. Holding member 110 includes a slot 112 for receiving a carrier that may be similar to carrier 36 as previously described. Further, the carrier may include a through hole in projection 52 to facilitate locking of the carrier with a locking mechanism 114. Mechanism 114 comprises a rod 116 that is moveable within slot 112 by operation of a handle 118. A spring 120 is used to bias rod 116 into slot 112. In this way, a carrier is inserted into slot 112 by depressing handle 118 to withdraw rod 116 from slot 112. The carrier is then fully inserted. Handle 118 is then released to permit rod 116 to move through the through hole of the carrier and into slot 112 to lock the carrier in place.

Figure 15:
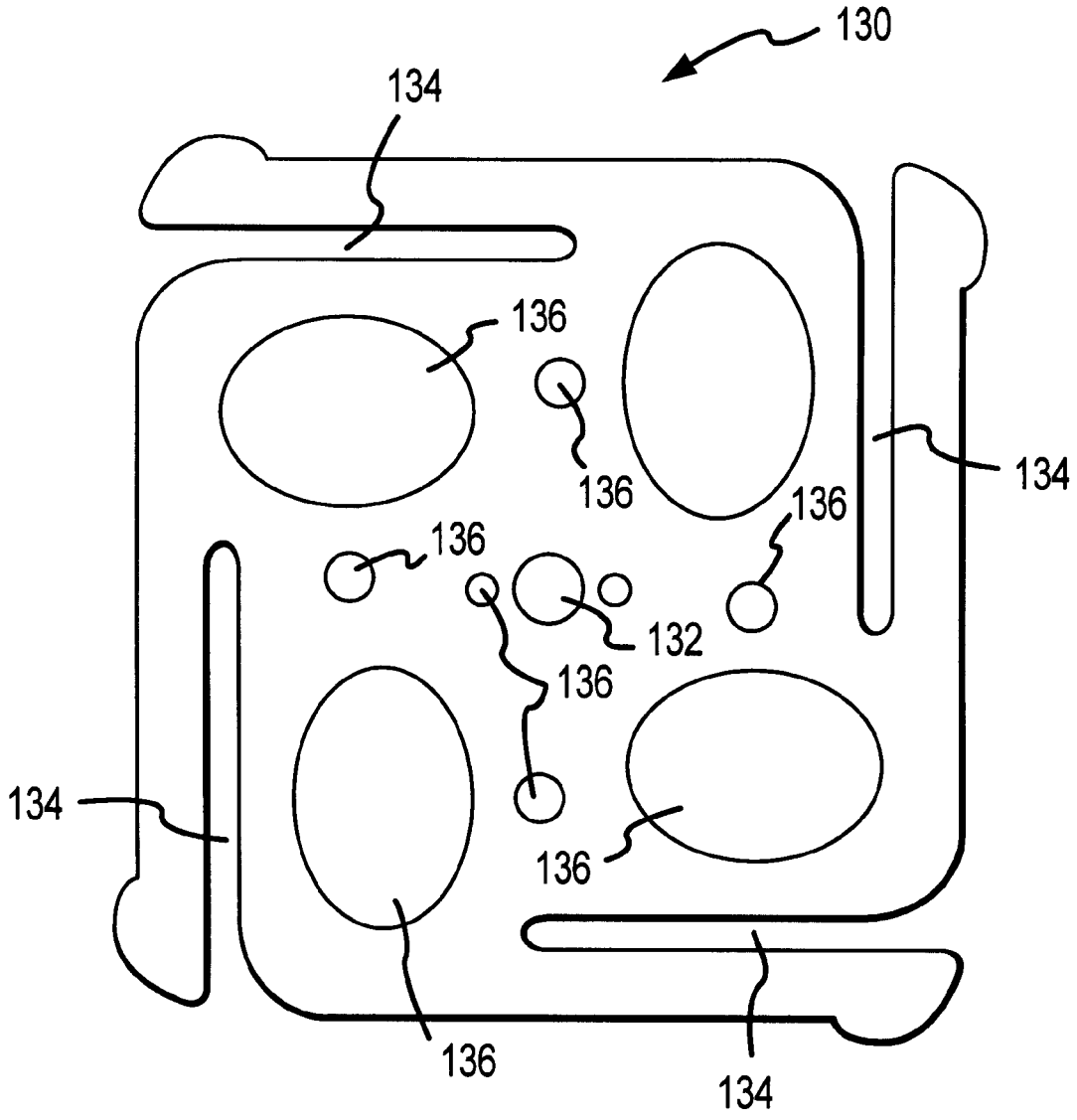
FIG. 15 is a side view of another holding member according to the invention.

FIG. 15 illustrates an alternative holding member 130 that may be used with the systems described herein. Holding member 130 includes a central hole 132 to permit holding member 130 to be coupled to a rotatable shaft similar to other embodiments. Although not shown, it will be appreciated that two or more holding members 130 may be coupled to the shaft to permit the carriers to be held between the holding members. As such, holding member 130 farther includes slots 134 into which the carriers are inserted in a manner similar to other embodiments. Holding member 130 further includes holes 136 of various shapes and sizes that are provided to reduce the mass of holding member 130, thereby reducing its inertia when rotating.

The invention has now been described in detail for purposes of clarity of understanding. However, it will be appreciated that certain changes and modifications may be practiced within the scope of the appended claims.

What is claimed is:

1. A mixing system comprising:

an elongate rotatable shaft having a horizontal rotational axis;

a plurality of holding members extending radially outward from the shaft and rotatable therewith;

a plurality of carriers that are insertable between two of the holding members, wherein each of the carriers is adapted to receive a plurality of cartridges that each include a chamber for holding a liquid, wherein rotation of the shaft rotates the carriers about the rotational axis to mix the liquid within the cartridge.

2. A system as in claim 1, wherein the carriers each comprise a carrier body having a bottom, a plurality of sides, an open top, a projection extending from opposite ones of the sides, and wherein the holding members include slots for receiving the projections of the carriers.

3. A system as in claim 2, wherein the grooves of the carrier are arranged such that the cartridges are parallel to each other when inserted into the grooves.

4. A system as in claim 3, wherein the grooves are keyed such that the cartridges are insertable in only one orientation.

5. A system as in claim 2, further comprising a locking mechanism to lock the carrier to the holding members.

6. A system as in claim 5, wherein at least one of the projections includes a knob, and wherein the locking mechanism comprises a biasing member that is received over the knob to lock the carrier to the holding member.

7. A system as in claim 1, further comprising a plurality of holding bars extending between the holding members, wherein the holding bars are configured to be placed adjacent a top end of the cartridges that extend above the top end of the carriers to hold the cartridges within the carriers when the shaft is rotated.

8. A system as in claim 1, wherein the slots in the holding members are 90 degrees apart to permit four carriers to be held between two of the holding members.

9. A system as in claim 1, wherein the number of holding members is three, and wherein a middle one of the holding members includes slots for carriers positioned on opposite sides of the middle holding member.

10. A system as in claim 1, wherein the cartridges include a pair of closely spaced apart walls that define the chamber, with the distance between the walls being less that the distance across either of the walls, and wherein the carriers are attached to the holding members such that the walls of the chambers are perpendicular to the rotational axis.

11. A mixing system as in claim 1, wherein rotation of the shaft is at a rate in the range from about 30 rpm to about 90 rpm.

12. A carrier that is adapted to hold a plurality of cartridges, the carrier comprising:

a carrier body having a bottom, a plurality of sides, an open top, a projection extending outward from opposite ones of the sides to facilitate coupling of the carrier body to a mixing device, wherein the carrier body is adapted to receive a plurality of cartridges that each include a chamber for holding a liquid, with the cartridges being generally parallel to each other.

13. A carrier as in claim 12, wherein the grooves are keyed such that the cartridges are insertable in only one orientation.

14. A carrier as in claim 12, wherein said chamber is closed.

15. A carrier as in claim 12 wherein said chamber is generally rectangular or square.

16. A heating and mixing system comprising:

a heated oven having an interior and a motor;

an elongate rotatable shaft having a rotational axis, wherein the shaft is disposed horizontally across the interior of the oven and is coupled to the motor;

a plurality of holding members extending radially outward from the shaft and rotatable therewith;

a plurality of carriers that are insertable between two of the holding members, wherein each of the carriers is adapted to receive a plurality of cartridge that each include a chamber for holding a liquid, wherein rotation of the shaft rotates the carriers about the rotational axis to mix the liquid within the cartridges.

17. A system as in claim 16, further comprising a controller to control operation of the motor and the temperature within the interior.

18. A system as in claim 16, wherein each carrier includes a plurality of grooves, pairs of which are adapted to receive the cartridges, wherein the carriers each further comprise a carrier body having a bottom, a plurality of sides, an open top, a projection extending from opposite ones of the sides, and wherein the holding members include slots for receiving the projections of the carriers.

19. A system as in claim 18, wherein the grooves of the carrier are arranged such that the cartridges are parallel to each other when inserted into the grooves.

20. A system as in claim 19, wherein the grooves are keyed such that the cartridges are insertable in only one orientation.

21. A system as in claim 18, further comprising a locking mechanism to lock the carrier to the holding members.

22. A system as in claim 21, wherein at least one of the projections includes a knob, and wherein the locking mechanism comprises a biasing member that is received over the knob to lock the carrier to the holding member.

23. A system as in claim 16, further comprising a plurality of holding bars extending between the holding members, wherein the holding bars are configured to be placed adjacent a top end of the cartridges that extend above the top end of the carriers to hold the cartridges within the carriers when the shaft is rotated.

24. A system as in claim 16, wherein the slots in the holding members are 90 degrees apart to permit four carriers to be held between two of the holding members.

25. A system as in claim 16, wherein the number of holding members is three, and wherein a middle one of the holding members includes slots for carriers positioned on opposite sides of the middle holding member.

26. A system as in claim 16, wherein the cartridges include a pair of closely spaced apart walls that define the chamber, with the distance between the walls being less that the distance across either of the walls, and wherein the carriers are attached to the holding members such that the walls of the chambers are perpendicular to the rotational axis.

27. A method for heating and mixing a liquid, the method comprising:

providing a plurality of cartridges that each have a chamber at least partially filled with a liquid;

placing the cartridges into a plurality of carriers;

inserting the carriers between a pair of holding members that extend radially outward from a shaft having a horizontal rotational axis; and rotating the shaft to rotate the cartridges around the rotational axis to mix the liquid within the chambers.

28. A method as in claim 27, further comprising heating the cartridges while rotating the shaft.

29. A method as in claim 28 wherein the heating step comprises rotating the cartridges within an oven.

30. A method as in claim 27 wherein the cartridges include a pair of closely spaced apart walls that define the chamber, with the distance between the walls being less that the distance across either of the walls, and further comprising inserting the carriers between the holding members such that the walls of the chambers are perpendicular to the rotational axis.

31. A method as in claim 30, wherein the cartridges further include sides extending between the faces to farther define the chamber, wherein the sides are angled relative to each other to form corners, and further comprising inserting the carriers between the holding members such that the corners are parallel to the rotational axis, and wherein rotation of the cartridges agitates the liquid within the chambers as the flow of the liquid changes direction due to the change in direction of the sides.

32. A method as in claim 27, wherein the carriers each comprise a carrier body having a bottom, a plurality of sides, an open top, a projection extending from opposite ones of the sides, and further comprising inserting the projections into slots in the holding members.

33. A method as in claim 32, further comprising placing the cartridges into the grooves of the carrier such that the cartridges are parallel to each other.

34. A method as in claim 33, further comprising preventing insertion of the cartridges into the grooves unless the cartridges are in a certain orientation.

35. A method as in claim 27, further comprising locking the carriers to the holding members.

36. A method as in claim 27, further comprising preventing the cartridges from sliding out of the carriers when the shaft is rotated.

37. A mixing system comprising:

an elongate rotatable shaft having a rotational axis;

a plurality of holding members extending radially outward from the shaft and rotatable therewith;

a plurality of carriers that are insertable between two of the holding members, wherein each of the carriers is adapted to receive a plurality of cartridges that each include a chamber for holding a liquid, wherein rotation of the shaft rotates the carriers about the rotational axis to mix the liquid within the cartridges; and a plurality of holding bars extending between the holding members, wherein the holding bars are configured to be placed adjacent a top end of the cartridges that extend above the top end of the carriers to hold the cartridges within the carriers when the shaft is rotated.

38. A mixing system comprising:

an elongate rotatable shaft having a rotational axis;

three holding members extending radially outward from the shaft and rotatable therewith; and a plurality of carriers that are insertable between two of the holding members, a middle one of the holding members including slots for carriers positioned on opposite sides of the middle holding member;

wherein each of the carriers is adapted to receive a plurality of cartridges that each include a chamber for holding a liquid, wherein rotation of the shaft rotates the carriers about the rotational axis to mix the liquid within the cartridges.

* * * * *

UNITED STATES PATENT AND TRADEMARK OFFICE

CERTIFICATE OF CORRECTION

PATENT NO. : 6,386,749 B1 
DATED : May 14, 2002
INVENTOR(S) : Richard P. Watts and Stephen D. Mitchell It is certified that error appears in the above-identified patent and that said Letters Patent is hereby corrected as shown below:

Title page,
Item [60], please delete the following:

-- Related U.S. Application Data
[60] Provisional application No. 60/222,675, filed on Aug. 2, 2000.

Column 1,
Line 3, please delete the following:
-- This application claims benefit to U.S. provisional application Ser. No. 60/222,675, filed Aug. 2, 2000. --

Signed and Sealed this

Eighth Day of October, 2002

*Attest:*

*Attesting Officer*

JAMES E. ROGAN
*Director of the United States Patent and Trademark Office*